US006679061B2

(12) United States Patent
Steinbach et al.

(10) Patent No.: US 6,679,061 B2
(45) Date of Patent: Jan. 20, 2004

(54) PREMIX BURNER ARRANGEMENT FOR OPERATING A COMBUSTION CHAMBER

(75) Inventors: Christian Steinbach, Neuenhof (CH); Timothy Albert Griffin, Ennetbaden (CH); Peter Jansohn, Küssaberg (DE); Thomas Ruck, Rekingen (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 09/991,968

(22) Filed: Nov. 26, 2001

(65) Prior Publication Data

US 2002/0189257 A1 Dec. 19, 2002

(30) Foreign Application Priority Data

Dec. 11, 2000 (DE) ..... 100 61 526

(51) Int. Cl.[7] ..... F23R 3/40

(52) U.S. Cl. ..... 60/777; 60/723; 60/737; 431/7

(58) Field of Search ..... 60/723, 737, 777; 431/7, 182, 170

(56) References Cited

U.S. PATENT DOCUMENTS

| | | | | |
|---|---|---|---|---|
| 5,165,224 A | * | 11/1992 | Spadaccini et al. | 60/780 |
| 5,318,436 A | * | 6/1994 | Colket, III et al. | 431/8 |
| 5,452,574 A | * | 9/1995 | Cowell et al. | 60/723 |
| 5,954,495 A | * | 9/1999 | Knopfel et al. | 431/285 |
| 6,125,625 A | * | 10/2000 | Lipinski et al. | 60/723 |

FOREIGN PATENT DOCUMENTS

| | | | |
|---|---|---|---|
| DE | 4439619 A1 | | 5/1996 |
| DE | 19654009 A1 | | 6/1998 |
| DE | 19521356 C2 | | 4/1999 |
| EP | 0710797 A2 | | 5/1996 |
| EP | 0797051 A2 | * | 3/1997 |
| EP | 0849451 A2 | | 6/1998 |
| EP | 0909921 A1 | | 4/1999 |
| JP | 6-129641 | * | 5/1994 |
| JP | 06174233 A | | 6/1994 |

* cited by examiner

*Primary Examiner*—Ted Kim
(74) *Attorney, Agent, or Firm*—Burns, Doane, Swecker & Mathis, L.L.P.

(57) ABSTRACT

Described is a premix burner arrangement as well as a method for operating the same, comprising a pilot fuel feeding means for operating a combustion chamber of a gas turbine arrangement, a premix burner, wherein at least one fuel addition unit as well as supply air openings have been provided in such a way that gaseous and/or liquid fuel can be mixed with combustion supply air inside the premix burner and form a fuel/air mixture, which exits from the premix burner downstream in the direction towards the combustion chamber positioned after the premix burner arrangement and which can be ignited inside the combustion chamber in the form of a spatially largely stationary flame.

The invention is characterized in that outside of the premix burner, a catalyzer unit is provided, through which the pilot fuel feeding is performed in such a way that a pilot fuel/air mixture flows through the catalyzer unit and can be converted in it at least in part catalytically, and flows as a mass flow that stabilizes the flame into the combustion chamber.

14 Claims, 2 Drawing Sheets

PREMIX BURNER ARRANGEMENT FOR OPERATING A COMBUSTION CHAMBER

FIELD OF THE INVENTION

The invention relates to a premix burner arrangement as well as to a method for operating the same, comprising a pilot fuel feeding means for operating a combustion chamber of a gas turbine arrangement, a premix burner housing, wherein at least one fuel addition unit as well as supply air openings have been provided in such a way that gaseous and/or liquid fuel can be mixed with combustion supply air inside the premix burner housing and form a fuel/air mixture, which exits from the premix burner housing downstream in the direction towards the combustion chamber positioned after the premix burner arrangement and which can be ignited inside the combustion chamber in the form of a spatially largely stationary flame.

BACKGROUND OF THE INVENTION

A premix burner of the above mentioned type is the subject of German Offenlegungsschrift DE 196 54 009 A1. The known premix burner comprises a conically expanding housing, within which a fuel/air mixture is formed by providing air inlet slits in an appropriate manner. Furthermore, a swirl generator is provided downstream, which provides the fuel/air mixture, after the latter passes the premix burner, with a specific, critical swirl value necessary for a spatially stabile flame that forms inside the combustion chamber after the ignition of the fuel/air mixture. The start-up or ignition of such premix burners requires a targeted feeding of the pilot gas into the premix burner. After igniting the pilot gas fed into the premix burner, a diffusion flame for igniting the fuel/air mixture produced axially in the premix burner forms, whereby said fuel/air mixture in the ideal case forms a spatially stable flame front near the backflow zone. The pilot gas feeding means also helps in increasing the flame stability in the lower partial load range of the premix burner, i.e., under operating conditions in which the premix burner is operated with lean mixtures.

Special attention in the operation of such premix burner systems is paid to the waste gas values occurring during the combustion, and in particular to NOx emissions, which, however, significantly increase during the additional piloting and resulting diffusion flame as a result of rising flame temperatures.

In order to reduce NOx emissions, and for other reasons, premix burners with a subsequent mixing section as disclosed, for example, in EP 0 83 105 A2, have become known. Inside the mixing section that follows the premix burner, the fuel/air mixture is able to mix completely before the mixture is ignited in the combustion chamber. However, for the startup and also for operating conditions with only lean mixture supply, burner systems optimized in this manner require an actually known piloting means as used, in particular, in the lower partial load operation of gas turbine systems. Here also the additional pilot gas supply has a strong influence on the NOx emissions produced by the combustion, in spite of the additional mixing section.

SUMMARY OF THE INVENTION

The invention is based on the objective of constructing a premix burner arrangement comprising a pilot fuel feeding means for operating a combustion chamber of a gas turbine arrangement, a premix burner housing, wherein at least one fuel addition unit as well as supply air openings have been provided in such a way that gaseous and/or liquid fuel can be mixed with combustion supply air inside the premix burner housing and form a fuel/air mixture, which exits from the premix burner housing downstream in the direction towards the combustion chamber positioned after the premix burner arrangement and which can be ignited inside the combustion chamber in the form of a spatially largely stationary flame in such a way that on the one hand the NOx emission values occurring during the combustion should be decisively reduced, and on the other hand the stability of the flame forming inside the combustion chamber should be maintained or optimized. The constructive measures necessary for this should be as economical as possible and also should be retrofittable for premix burner arrangements already in operation.

The method discloses a method according to the invention for operating a premix burner arrangement with pilot fuel feeding means. Characteristics that advantageously further develop the concept of the invention are the subject of the secondary claims and specification, in particular in reference to the exemplary embodiments.

According to the invention, a premix burner arrangement with a pilot fuel feeding means for operating a combustion chamber of a gas turbine arrangement according to the preamble of claim 1 is constructed so that outside of the premix burner, a catalyzer unit is provided, through which the pilot fuel feeding is performed in such a way that a pilot fuel/air mixture flows through the catalyzer unit and can be converted at least in part catalytically in it and flows as a mass flow that stabilizes the flame into the combustion chamber.

The term "premix burner" relates to a premix burner arrangement composed of a preferably conically constructed premix burner housing containing at least one fuel injection means as well as supply air openings, through which flows supply air for forming a fuel/air mixture inside the premix burner housing, a swirl generator that follows the premix burner housing downstream, as well as an optional mixing section following the swirl generator.

Regardless of whether the premix burner arrangement is provided with a mixing section that follows the swirl generator, the concept according to the invention moves away from the actually known pilot gas feeding means inside the premix burner, for example, using a pilot gas lance, and principally provides for a catalytic conversion of a pilot fuel even before the latter reaches the area of the combustion chamber. By means of the at least partial catalytic conversion of the supplied pilot fuel, that is mixed with air prior to entering the catalyzer unit and flows through the catalyzer unit in the form of a pilot fuel/air mixture, at least a large part of the pilot fuel is converted thermally and/or catalytically, creating a mass flow entering the combustion chamber, said mass flow consisting in the form of an ignitable gas mixture or alternatively as a type of hot gas flow. The mass flow having the form of an ignitable gas mixture then directly reaches the area of the flame front inside the combustion chamber, whereupon it is ignited and creates only the smallest of NOx emissions. Even in the case of a complete chemical conversion of the pilot fuel, which results, for example, in a mass flow in the form of a hot gas, preferably consisting of the full oxidation products $CO_2$ and $H_2$, only the smallest portions of NOx are created.

Since, with respect to the substance, the catalytic conversion of the pilot fuel takes place completely separate from the fuel/air mixture forming inside the premix burner, the pilot fuel can be freely selected with respect to type and volume of supply through the catalyzer unit.

The catalyzer unit preferably is arranged downstream on the premix burner, immediately before entering the combustion chamber or downstream from the mixing section following the swirl generator in such a way that the catalyzer unit surrounds the mixing section at least in part in a circular manner. It was found to be especially advantageous for a catalyzer unit arranged circularly around the mixing section that the catalytically converted mass flow flowing from the catalyzer unit into the combustion chamber is able to decisively stabilize the flame front forming inside the combustion chamber in the area of the backflow zone. The catalytically converted mass flow preferably meets the flame front that forms in paraboloid manner inside the combustion chamber in edge regions, which makes it possible, as confirmed experimentally, to increase the stability of the flame. This is true in particular for an operation with lean fuel/air mixtures, as is the case in the lower partial load range.

Exemplary embodiments for constructively designing the pilot fuel feeding means according to the invention are found in the following figures.

BRIEF DESCRIPTION OF DRAWINGS

The invention is described below as an example, using exemplary embodiments in reference to the drawing without limiting the general idea of the invention. Hereby.

DETAILED DESCRIPTION OF THE INVENTION

Figure 1:
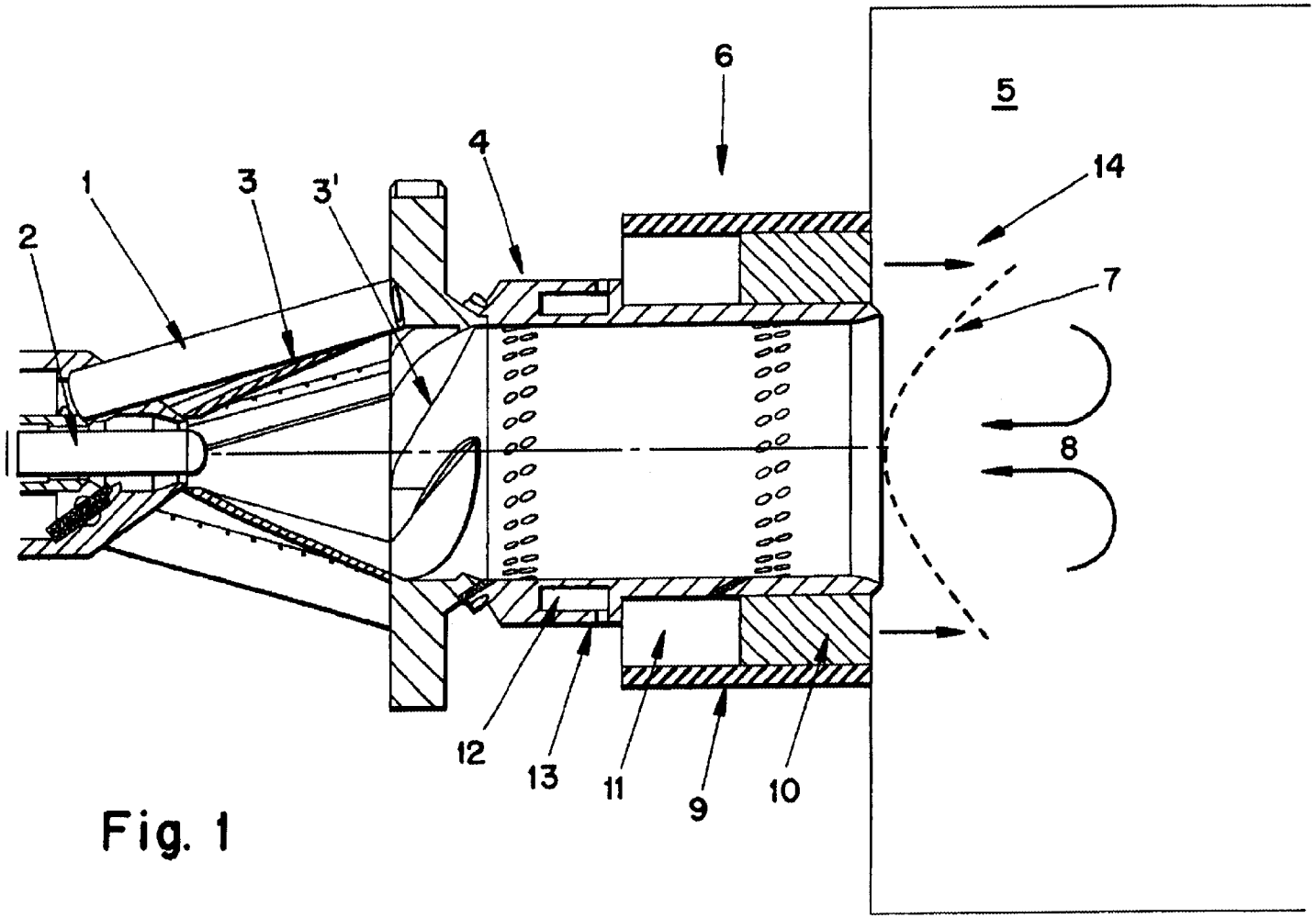
FIG. 1 shows a longitudinal section through a premix burner arrangement with catalytic pilot fuel feeding means; and, FIG. 2 shows a longitudinal section through a premix burner arrangement with alternative pilot fuel feeding means.

FIG. 1 shows a longitudinal section through a premix burner arrangement with a conically constructed premix burner housing 1, in which a fuel addition unit 2, for example, in the form of an atomizing nozzle through which liquid fuel can be atomized, is provided. Via supply air openings 3 along the premix burner housing 1, supply air reaches the inside of the premix burner, where, in the presence of swirl-generating means 3', the so-called swirl generator, a fuel/air mixture is formed, which reaches the mixing pipe 4 downstream for complete intermixing. The combustion chamber 5 in which a stable flame front 7 forms inside the backflow zone 8 in an actually known manner is provided downstream from the mixing pipe 4.

A catalyzer unit 6 that circularly completely surrounds the mixing pipe 4 is provided outside of the mixing pipe 4.

The catalyzer unit 6 is constructed of a cylinder sleeve 9 completely surrounding the mixing pipe 4 at its end facing the combustion chamber 5, which encloses a volume limited by the outside wall of the mixing pipe 4, in whose part facing the combustion chamber 5 catalyzer material 10 is provided. Downstream, the catalyzer 10 directly borders on the combustion chamber 5, so that a mass flow passing through the catalyzer 10 is able to flow directly into the combustion chamber 5 (see arrow). The catalyzer 10 inside the catalyzer unit 6 is preceded upstream by a mixing section 11, in which supplied pilot fuel is able to completely mix with air. Pilot fuel is supplied, preferably in gaseous form, for example as butane or methane, via a pilot fuel supply line 12 integrated into the mixing pipe 4, which is provided directly before the entrance into the mixing section 11 of the catalyzer unit 6. Via a pilot fuel atomization means 13, the pilot fuel reaches the premix section 11 of the catalyzer unit and flows through the catalyzer 10 as a pilot fuel/air mixture Within the catalyzer 10, at least parts of the pilot fuel are converted catalytically and/or thermally, so that after passing through the catalyzer unit 10 a mass flow 14 in the form of a preferably ignitable gas mixture flows into the combustion chamber 5. The mass flow 14 encounters the flame front 7 in edge areas, where the mass flow 14 is able to significantly help in stabilizing the flame front.

Figure 2:
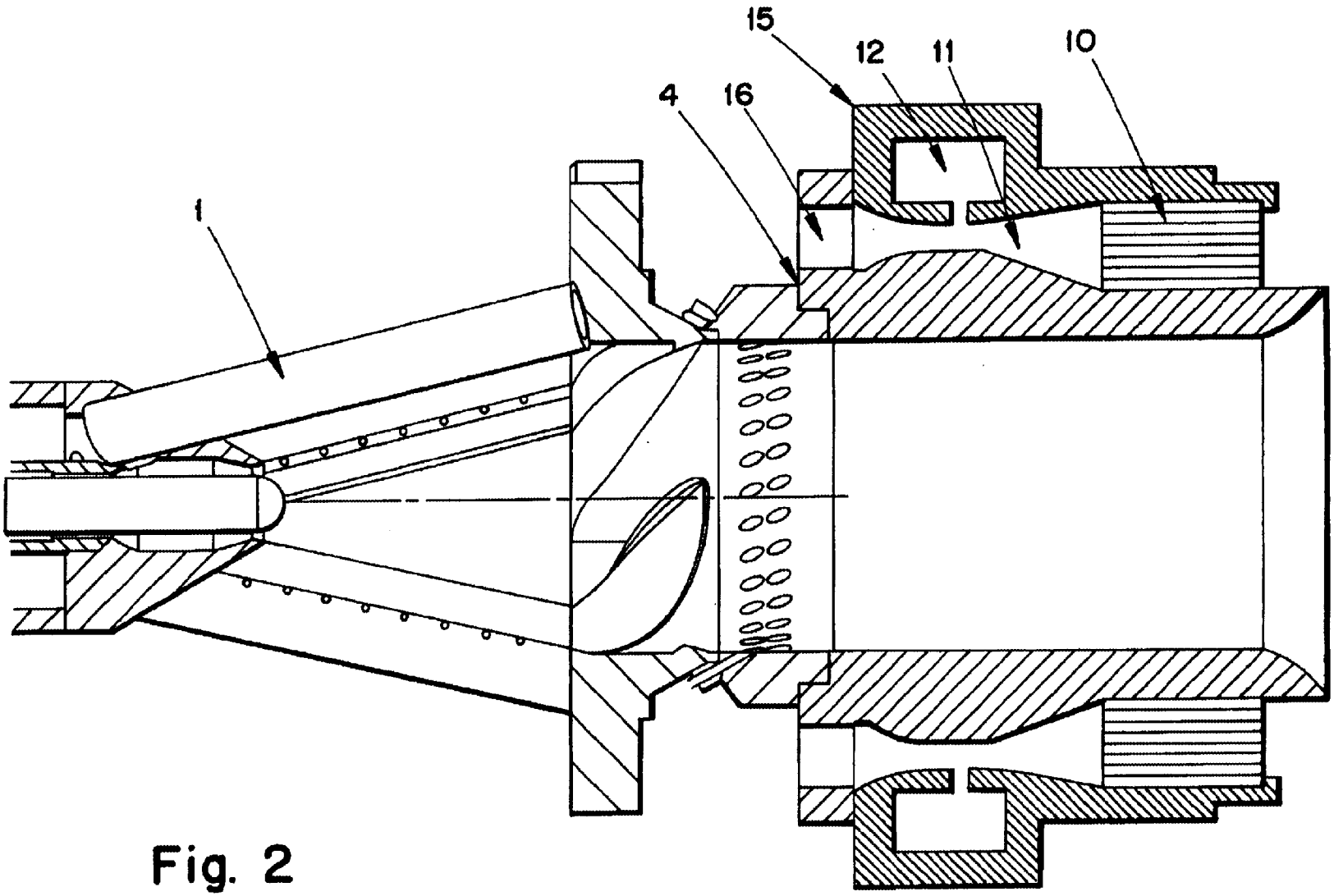

FIG. 2 shows an alternative embodiment of the pilot fuel feeding means for a premix burner arrangement according to FIG. 1. Similar to the exemplary embodiment of FIG. 1, the premix burner arrangement illustrated in FIG. 2 is provided with a conically constructed premix burner 1, which is connected downstream with a mixing pipe 4 that again borders on a combustion chamber (not shown) downstream.

An outer housing 15 that circularly surrounds the mixing pipe and encloses a pilot fuel supply means 12 is arranged around the mixing pipe 4. Together with the mixing pipe 4, the outer housing 15 encloses an intermediate slit 16, through which supply air is able to flow into a mixing section 11 constructed as a venture tube. Within the mixing section 11, at the point where the venture tube has its narrowest flow cross-section, pilot fuel enters the mixing section 11 and is mixed along with the supply air to form a pilot fuel/air mixture. Downstream, the mixture passes through the catalyzer 10, in which the pilot fuel is converted at least in part thermally and/or catalytically and enters the combustion chamber 5 as a preferably ignitable gas mixture.

The measure according to the invention of catalytic piloting immediately before the entrance into the combustion chamber makes it possible both to decisively reduce the increases in NOx emission values usually associated with pilot gas supply means, and also allows the pilot gas supply flowing into the combustion chamber in the edge areas of the flame front to decisively stabilize the flame, in particular in critical load ranges of the gas turbine system.

List of Reference Numerals

1 Premix burner housing
2 Fuel addition unit
3 Supply air opening
3' Swirl-generating means, swirl generator
4 Mixing pipe
5 Combustion chamber
6 Catalyzer unit
7 Flame front
8 Backflow zone
9 Catalyzer housing
10 Catalyzer
11 Mixing volume, mixing section
12 Pilot fuel supply line
13 Pilot fuel atomization means
14 Catalytically converted mass flow
15 Outer housing
16 Intermediate slit

What is claimed is:

1. Premix burner arrangement comprising a pilot fuel feeding means for operating a combustion chamber of a gas turbine arrangement, a double cone premix burner wherein at least one fuel addition unit as well as supply air openings have been provided in such a way that gaseous and/or liquid fuel can be mixed with combustion supply air inside the premix burner and form a fuel/air mixture, which exits from the premix burner downstream in the direction towards the combustion chamber positioned after the premix burner and which can be ignited inside the combustion chamber in the form of a spatially largely stationary flame, wherein outside of the premix burner, a catalyzer unit is provided, through which the pilot fuel is injected from the side and feeding is performed in such a way that a pilot fuel/air mixture flows through the catalyzer unit and can be converted at least in part catalytically in the catalyzer unit, and flows as a mass flow that stabilizes the flame into the combustion chamber, the pilot fuel feeding means being immediately adjacent the double cone premix burner, and wherein a rich pilot fuel/air mixture passes through the catalyzer unit and forms a $H_2$/CO mixture, thereby stabilizing the flame front chemically.

2. Premix burner arrangement according to claim 1, wherein the catalyzer unit surrounds the premix burner downstream at its outlet, prior to the entrance into the combustion chamber, at least in part in a circular manner.

3. Premix burner arrangement according to claim 1, wherein for the pilot fuel feeding a pilot fuel supply line as well as a pilot fuel atomization means, which introduces the pilot fuel into a mixing section, in which the introduced pilot fuel can be mixed with supply air in order to form the pilot fuel/air mixture passing through the catalyzer unit, are provided.

4. Premix burner arrangement as claimed in claim 1, wherein the mass flow exiting from the catalyzer unit flows into the combustion chamber in direct proximity to the fuel/air mixture exiting from the premix burner.

5. Premix burner arrangement as claimed in claim 1, wherein the mass flow exiting from the catalyzer unit surrounds the fuel/air mixture exiting from the premix burner completely in a circular manner and enters into the combustion chamber.

6. Premix burner arrangement as claimed in claim 3, wherein the pilot fuel supply line, the pilot fuel atomization means, the mixing section, as well as the catalyzer unit are arranged circularly around the premix burner and are bordered by the latter on one side.

7. Premix burner arrangement as claimed in claim 1, wherein the premix burner provides a conically constructed premix burner housing with swirl generator, as well as a mixing pipe, which follows the swirl generator downstream and is connected downstream with the combustion chamber.

8. Premix burner arrangement according to claim 7, wherein the conical premix burner housing, the swirl generator, and the mixing pipe are constructed as separate components.

9. Premix burner arrangement according to claim 7, wherein the catalyzer unit is provided in the area of the end of the mixing pipe facing towards the combustion chamber.

10. Premix burner arrangement as claimed in claim 1, wherein the pilot fuel is gaseous.

11. Premix burner arrangement as claimed in claim 1, wherein the mass flow exiting from the catalyzer unit is an ignitable gas mixture.

12. Method for operating a premix burner arrangement comprising a pilot fuel feeding means for operating a combustion chamber of a gas turbine arrangement, with a double cone premix burner in which gaseous and/or liquid fuel are mixed with combustion supply air to form a fuel/air mixture, which exits from the premix burner downstream in the direction towards the combustion chamber that follows the premix burner and is ignited inside the combustion chamber, the pilot fuel feeding means injecting fuel from the side and located immediately adjacent the double cone premix burner, wherein, separately from the fuel/air mixture, a pilot fuel is mixed together with supply air to form a pilot fuel/air mixture outside of the premix burner, where said pilot fuel/air mixture is passed through a catalyzer unit and it is at least partially catalytically converted and enters the combustion chamber, and wherein a rich pilot fuel/air mixture passes through the catalyzer unit and forms a $H_2$/CO mixture, thereby stabilizing the flame front chemically.

13. Method as claimed in claim 12, wherein, after exiting from the catalyzer unit, the pilot fuel/air mixture encloses the fuel/air mixture circularly and is ignited in the combustion chamber together with the fuel/air mixture.

14. Method as claimed in claim 12, wherein, after passing through a mixing section within a mixing pipe, the fuel/air mixture reaches the combustion chamber and is combined with the pilot fuel/air mixture.

* * * * *